US010428560B2

(12) United States Patent
Dente et al.

(10) Patent No.: US 10,428,560 B2
(45) Date of Patent: Oct. 1, 2019

(54) ELECTRICAL DOOR LATCH

(71) Applicant: Magna Closures S.p.A., Guasticce (Leghorn) (IT)

(72) Inventors: Davide Dente, Pisa (IT); Emanuele Leonardi, Pisa (IT); Antonio Frello, Leghorn (IT)

(73) Assignee: MAGNA CLOSURES S.P.A., Guasticce (Leghorn) (IT)

( * ) Notice: Subject to any disclaimer, the term of this patent is extended or adjusted under 35 U.S.C. 154(b) by 46 days.

(21) Appl. No.: 15/244,198

(22) Filed: Aug. 23, 2016

(65) Prior Publication Data

US 2017/0074008 A1 Mar. 16, 2017

Related U.S. Application Data

(60) Provisional application No. 62/217,526, filed on Sep. 11, 2015.

(51) Int. Cl.

| | |
|---|---|
| ***E05B 81/56*** | (2014.01) |
| ***E05B 77/30*** | (2014.01) |
| ***E05B 81/76*** | (2014.01) |
| ***E05B 77/54*** | (2014.01) |
| ***E05B 77/22*** | (2014.01) |
| ***E05B 81/06*** | (2014.01) |
| ***E05B 81/58*** | (2014.01) |

(52) U.S. Cl.

CPC ..... *E05B 81/56* (2013.01); *E05B 77/22* (2013.01); *E05B 77/30* (2013.01); *E05B 81/06* (2013.01); *E05B 81/58* (2013.01); *E05B 81/76* (2013.01); *E05B 77/54* (2013.01)

(58) Field of Classification Search

CPC ..... E05B 81/56; E05B 81/06; E05B 81/58; E05B 81/76; E05B 77/22; E05B 77/30; E05B 77/54; Y10S 292/23

See application file for complete search history.

(56) References Cited

U.S. PATENT DOCUMENTS

| | | | | |
|---|---|---|---|---|
| 5,619,412 | A * | 4/1997 | Hapka | B60R 25/04 123/179.2 |
| 7,399,010 | B2 | 7/2008 | Hunt et al. | |
| 8,474,888 | B2 | 7/2013 | Tomaszewski | |
| 8,573,657 | B2 | 11/2013 | Papanikolaou et al. | |
| 9,744,943 | B1 * | 8/2017 | Hiatt | B60R 25/04 |
| 2010/0207400 | A1 | 8/2010 | Tomaszewski et al. | |
| 2013/0104459 | A1 * | 5/2013 | Patel | E05B 47/0657 49/70 |
| 2014/0175813 | A1 | 6/2014 | Margheritti et al. | |

(Continued)

*Primary Examiner* — Abby Y Lin

(74) *Attorney, Agent, or Firm* — Dickinson Wright PLLC

(57) ABSTRACT

An e-latch assembly for a closure member and a method of operating the e-latch assembly coupled to a closure member are provided. The e-latch assembly includes an actuation group operable to selectively secure the closure member. An electronic control circuit is coupled to the actuation group and includes a control unit configured to manage a plurality of handle activation signals. The control unit is also configured to receive a plurality of signals indicative of the state of a vehicle. Additionally, the control unit is configured to control the actuation group to selectively allow the closure member to be opened in response to receiving the plurality of signals indicative of the state of the vehicle and based on the plurality of handle activation signals.

16 Claims, 4 Drawing Sheets

(56) References Cited

U.S. PATENT DOCUMENTS

| | | | | |
|---|---|---|---|---|
| 2015/0330111 | A1 | 11/2015 | Dente et al. | |
| 2015/0330112 | A1* | 11/2015 | Van Wiemeersch .... | E05B 81/76 292/201 |
| 2015/0330116 | A1 | 11/2015 | Dente | |

* cited by examiner

ELECTRICAL DOOR LATCH

CROSS REFERENCE TO RELATED APPLICATION

This application claims the benefit of U.S. Provisional Application Ser. No. 62/217,526 filed Sep. 11, 2015, which is incorporated herein by reference in its entirety.

FIELD

The present disclosure relates generally to door latches, and, in particular, to electronic latch assemblies (commonly known as e-latch assemblies), such as may be employed in motor vehicle closure systems. The present disclosure also relates to a method of operating the electronic latch assembly.

BACKGROUND

This section provides background information related to the present disclosure which is not necessarily prior art.

One of the defining characteristics of an electrical door latch (e-latch) is that it does not have a mechanical linkage to an outside or inside door handle. Instead, the door is released by an actuator, in response to an electrical signal coming from the handles.

Consequently, there are many features that can be achieved with an e-latch that would ordinarily require complex mechanical designs to realize with a conventional mechanical door latches. One such feature is a double pull unlock where the first activation of a vehicle inside handle unlocks the door, and the second activation releases the door. This is a desirable feature to many original equipment manufacturers (OEM's) as a safely measure to ensure that a single accidental activation of the inside handle, while the vehicle is in motion, does not result in the door opening.

Latching systems of motor vehicles may also employ an "auto-lock" feature which places the vehicle into a locked condition while the vehicle is in motion. Thus, double pull unlock can be perceived as a redundant operation and a nuisance to users when combined with such "auto-lock" features. For instance, once a vehicle is parked, a user of a conventional mechanical door latch is required to perform a double pull inside handle activation to mechanically unlock then release the door, or, electrically unlock using a switch which allows a single inside handle activation to release the door.

In addition, with conventional mechanical door latches implementing features such as double pull unlock, the first activation of the inside handle mechanically unlocks the latch and the second activation releases the door. Therefore, there is the possibility that an occupant can accidentally activate the inside handle and unknowingly unlock the door. A conventional door latch will remain in this unlocked state indefinitely, even if it occurs when the vehicle is in motion. As a result, there may be a risk that only a single activation later will release the door.

Accordingly, there remains a need for improved latch assemblies and methods of operation for the e-latch assemblies that provide enhanced safety and convenience while reducing reliance on complex mechanical designs.

SUMMARY

This section provides a general summary of the present disclosure and is not intended to be interpreted as a comprehensive disclosure of its full scope or all of its features, aspects and objectives.

Accordingly, it is an aspect of the present disclosure to provide a method of operating an e-latch assembly coupled to a closure member including the step of locking the e-latch assembly. Next, monitoring for a first handle activation signal. The method proceeds by receiving the first handle activation signal and determining whether a preset time has elapsed in response to receiving the first handle activation signal. Then, the next step of the method is monitoring for a second handle activation signal in response to the preset time not being elapsed. The method continues by ignoring the first handle activation signal in response to not receiving the second handle activation signal within the preset time. Next, receiving the second handle activation signal and determining that a multiple handle pull has occurred in response to receiving the second handle activation signal within the preset time. The method then includes the step of allowing the closure member to be opened in response to determining that a multiple handle pull has occurred.

According to another aspect of the disclosure, an additional method of operating an e-latch assembly coupled to a closure member is provided. The method includes the step of locking the e-latch assembly. The method continues by monitoring for a first handle activation signal. Then, receiving the first handle activation signal and checking a vehicle speed. The method then proceeds with the step of determining whether the vehicle speed satisfies a preset speed setting. The next step is releasing the closure member in response to the vehicle speed satisfying the preset speed setting and receiving the first handle activation signal. The method also includes the steps of monitoring for a second handle activation signal in response to the vehicle speed not satisfying the preset speed setting and receiving the second handle activation signal. The method concludes with the step of releasing the closure member in response to receiving the second handle activation signal.

According to another aspect of the disclosure, an e-latch assembly for a closure member is provided. The e-latch assembly includes an actuation group operable to selectively secure the closure member. An electronic control circuit is coupled to the actuation group and includes a control unit configured to manage a plurality of handle activation signals. The control unit is also configured to receive a plurality of signals indicative of the state of a vehicle. Additionally, the control unit is configured to control the actuation group to selectively allow the closure member to be opened in response to receiving the plurality of signals indicative of the state of the vehicle and based on the plurality of handle activation signals.

These and other aspects and areas of applicability will become apparent from the description provided herein. The description and specific examples in this summary are intended for purpose of illustration only and are not intended to limit the scope of the present disclosure.

DRAWINGS

The drawings described herein are for illustrative purposes only of selected embodiments and not all implementations, and are not intended to limit the present disclosure to only that actually shown. With this in mind, various features and advantages of example embodiments of the present disclosure will become apparent from the following written description when considered in combination with the appended drawings, in which.

DETAILED DESCRIPTION

In the following description, details are set forth to provide an understanding of the present disclosure. In some instances, certain circuits, structures and techniques have not been described or shown in detail in order not to obscure the disclosure.

In general, the present disclosure relates to an electronic latch or e-latch of the type well-suited for use in many applications. The e-latch assembly and associated methods of operation of this disclosure will be described in conjunction with one or more example embodiments. However, the specific example embodiments disclosed are merely provided to describe the inventive concepts, features, advantages and objectives will sufficient clarity to permit those skilled in this art to understand and practice the disclosure.

Referring to the Figures, wherein like numerals indicate corresponding parts throughout the several views, an electronic latch for a motor vehicle closure system and a method of operating the electronic latch are disclosed.

Figure 1:
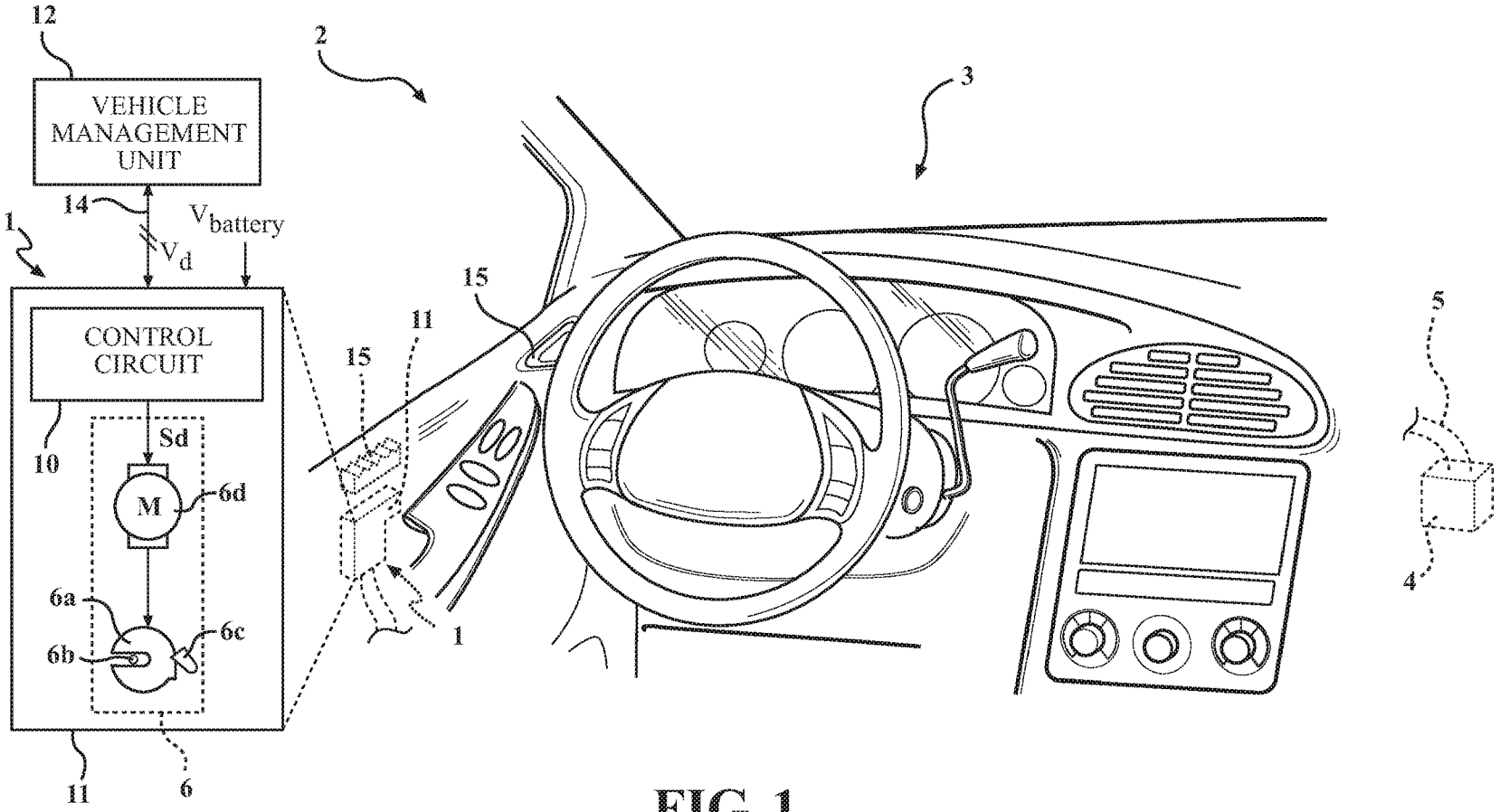
FIG. 1 is a schematic representation of a motor vehicle with a closure member and a related e-latch assembly according to aspects of the disclosure.
Figure 2:
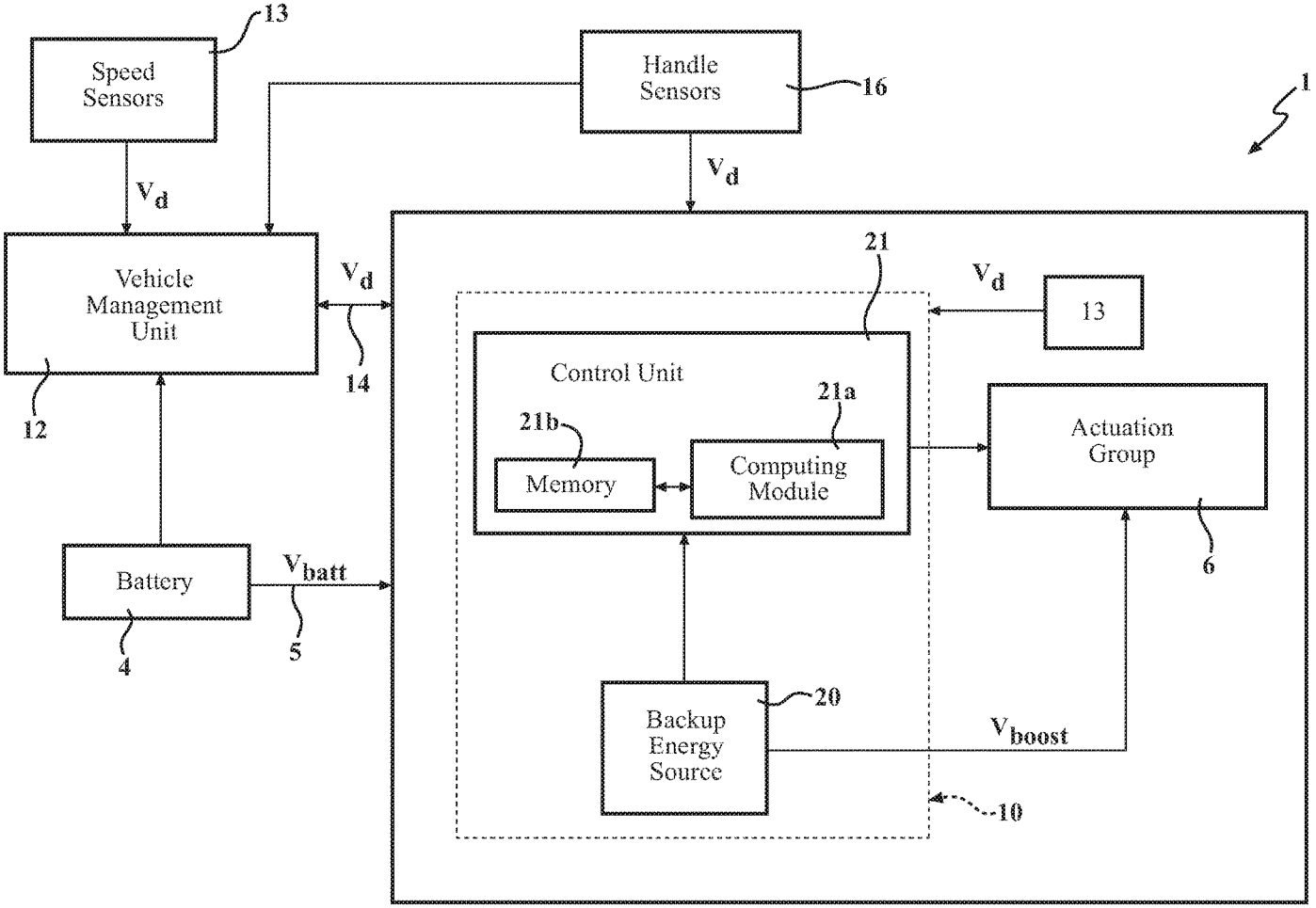
FIG. 2 is a general block diagram of an electronic control circuit of the e-latch assembly of FIG. 1 according to aspects of the disclosure.

Number 1 in FIGS. 1 and 2 generally indicates an electronic latch assembly (hereinafter e-latch assembly 1), coupled to a door 2 of a motor vehicle 3 (however, it is again emphasized that the e-latch assembly 1 may equally be coupled to any kind of closure member or device of the motor vehicle 3).

The e-latch assembly 1 is electrically connected to a main power source 4 of the motor vehicle 3, for example a main battery providing a battery voltage Vbatt of 12 Volts, through an electrical connection element 5, for example a power cable. It should be appreciated that the main power source 4 may include a different source of electrical energy within the motor vehicle 3, such as, but not limited to an alternator.

The e-latch assembly 1 includes an actuation group 6 including an electric motor 6*d*, operable to control actuation of the door 2 (or in general of the vehicle closure member).

In a possible embodiment, the actuation group 6 includes a ratchet 6*a*, which is selectively rotatable to engage a striker 6*b* (fixed to the body of the motor vehicle 3, for example to the so called "A pillar" or "B pillar", in a manner not shown in detail). When the ratchet 6*a* is rotated into a latching position with respect to the striker 6*b*, the door 2 is in a closed operating state. A pawl 6*c* selectively engages the ratchet 6*b* to prevent it from rotating. The pawl 6*c* is directly or indirectly driven by the electric motor 6*d*, so as to move between an engaged position and a non-engaged position.

The e-latch assembly 1 further includes an electronic control circuit 10, for example including a microcontroller or other known computing unit (discussed in detail below) and the actuation group 6. The electronic control circuit 10 is coupled to the actuation group 6 and provides the electric motor 6*d* with suitable driving signals Sd.

In a possible embodiment, the electronic control circuit 10 is conveniently embedded and arranged in the same housing or case 11 (shown schematically) together with the actuation group 6 of the e-latch assembly 1, thus providing an integrated compact and easy-to-assemble unit.

The electronic control circuit 10 is also electrically coupled to a vehicle management unit 12, which is configured to control general operation of the motor vehicle 3, via an electrical interconnect 14 (e.g., a data bus), so as to exchange signals, data, commands and/or information Vd indicative of a state of the motor vehicle 3 (e.g., vehicle speed Ss, sensed crash conditions, etc.).

The vehicle management unit 12 is also coupled to sensors 13, for example speed, accelerometer and/or force sensors, which provide signals Vd, for example speed, acceleration or force signals, which provide indication of the state of the vehicle 3 (presence of an emergency situation such as a crash, speed of the vehicle 3, current lock state of the e-latch assembly 1, etc.) to the vehicle management unit 12 and/or the electronic control circuit 10. It is recognized that the vehicle speed Ss and/or acceleration/force signals Vd can be interpreted by the vehicle management unit 12 and/or a control unit 21 to represent one or more of a variety of driving conditions experienced by the vehicle 3, for example the vehicle 3 being stopped (e.g. vehicle 3 is at rest), vehicle 3 being in motion under control (e.g. vehicle 3 is travelling appropriately in a forward or reverse direction), a vehicle impact situation, a vehicle roll over situation, deemed unsafe driving conditions (e.g. swerving or skidding), etc.

Conveniently, the electronic control circuit 10 also receives feedback information about the latch actuation from position sensors 13, such as Hall sensors, configured to detect the operating position of the actuation group 6 (e.g., locked state, unlocked state, opened state, closed state, etc.), for example of the ratchet 6*b* and/or pawl 6*c*; and also receives (e.g., directly and/or indirectly via the vehicle management unit 12) information Vd about user actuation of the vehicle (external and/or internal) handles 15 from handle sensors 16, which detect user activation of the internal and/or external handles 15 of the doors 2 of the motor vehicle 3. It is recognized that a multiple pull (e.g., double pull) actuation of the (external and/or internal) handles 15 would result in multiple handle activation signals Vd being received sequentially by a control unit 21 from the handle sensors 16, as further described below.

The electronic control circuit 10 can also be coupled to the main power source 4 of the motor vehicle 3, so as to receive the battery voltage Vbatt; the electronic control circuit 10 is able to check if the value of the battery voltage Vbatt decreases below a predetermined threshold value.

The electronic control circuit 10 can include an embedded and integrated backup energy source 20, which is configured to supply electrical energy to the electric motor 6*d* of the e-latch assembly 1 and to the same electronic control circuit 10, in case of failure or interruption of the main power source 4 of the motor vehicle 3.

In more details, the electronic control circuit 10 includes the control unit 21, for example provided with a microcontroller, microprocessor or analogous computing module 21*a*, coupled to the backup energy source 20 and the actuation group 6 of the e-latch assembly 1 (e.g., providing thereto the driving signal Sd to the actuation group 6), to control their operation.

The control unit 21 has an embedded memory 21*b*, for example a non-volatile random access memory, coupled to the computing module 21*a* for storing suitable programs and computer instructions (e.g., in the form of a firmware). It is recognized that the control unit 21 could alternatively comprise a logical circuit of discrete components to carry out the functions of the computing module 21*a* and memory 21*b*, including acting upon the vehicle state signals Vd, handle sensor signals Vd from handle sensor 16 and/or signals Vd from the position sensor 13, as further described below.

The control unit 21 is configured to control the e-latch assembly 1 for controlling actuation of the door 2, based on signals Vd detected by the handle sensors 16, which are indicative for example of the user intention to open the door 2 of the motor vehicle 3, and optionally based on signals Vd received from the vehicle management unit 12, which are indicative for example of a correct authentication of the user carrying suitable authentication means (such as in a key fob) and/or as indication of the state of the vehicle 3 (concerning vehicle speed Ss, for example).

According to a particular aspect, the control unit 21 is also configured to manage multiple pull (e.g., double pull) signals Vd received from the handle sensors 16 and to implement, locally to the e-latch assembly 1, a suitable control algorithm or a first release management method 100 to control the e-latch assembly 1 to appropriately (e.g. within an appropriate preset time between successive actuations of the handle 15, when the state of the vehicle 3 is deemed appropriate, such as at a speed of zero, or otherwise considered as rest) release the striker 6*b* from the ratchet 6*a* of the actuation group 6 of the e-latch assembly under a multiple pull scenario as further described below.

In addition, the control unit 21 can start a second release management method 101 (see FIGS. 3 and 4) for operating actuation group 6, in response to receiving vehicle state information signal Vd (e.g., indicative of the speed of the vehicle 3) from the vehicle management unit 12 and door actuation signals Vd received from the handle sensors 16. The release management method 101 operates with the e-latch assembly 1, in order to inhibit opening of the doors 2 of the motor vehicle 3 (thus disabling of the handles 15 and ability of the control unit 21 to disregard the one or more handle release signals Vd received from the handle sensors 16) in the event of the speed of the vehicle 3 being above a pre-set threshold (e.g. 0 km/hr), as further described below.

Alternatively or in addition to the operation described above, the control unit 21 can start the second release management method 100 for operating actuation group 6, in response to receiving vehicle state information signal Vd (e.g., indicative of the speed of the vehicle 3) from the vehicle management unit 12 and door actuation signals Vd received from the handle sensors 16. The release management method 101 operates with the e-latch assembly 1, in order to allow opening of the doors 2 of the motor vehicle 3 (thus causing enabling of the handles 15 and ability of the control unit 21 to act on the one or more handle release signals Vd received from the handle sensors 16) in the event of the speed of the vehicle 3 being at or below a pre-set threshold (e.g. 0 km/hr), as further described below.

In any event, multiple actuation signals Vd (e.g., double pull signals) received from the handle sensors 16 by the control unit 21 can be acted upon or disregarded based on the vehicle state information Vd received from the vehicle management unit 12. It is recognized that the vehicle state information Vd, other than speed, can also represent crash event information indicated the presence of or impending occurrence of a crash event (e.g. impact of the vehicle with another object or obstacle).

It is also recognized, as further described below, that actuation of the actuation group 6 by the control unit 21 can be done under the first release management method 100 (see FIG. 3) involving receipt by the control unit 21 of multiple handle release signals Vd from the handle sensors 16 (e.g., as a result of multiple actuations of the handles 15 by a user of the vehicle 3). In this regard, the control unit 21 is programmed to abide by a pre-set amount of time or time interval (as stored in the memory 21*b*) between generation of sequential handle release signals Vd (e.g. a second handle activation signal Vd is received by the control unit 21 within X seconds of a first handle activation signal Vd previously received by the control unit 21). It is recognized that the multiple handle activation signals Vd (as generated from the handle sensors 16) can be received by the control unit 21 at different times indicating multiple successive pulls/actuations of the handle 15 by the user the vehicle 3. It is recognized that the multiple handle activation signals Vd (as generated from the handle sensors 16) can be received by the control unit 21 at the same time but with different time stamps indicating multiple successive pulls/actuations of the handle 15 by the user of the vehicle 3.

The first and second release management methods 100, 101 can execute independently from the availability of the main power source 4 of the motor vehicle 3, and the battery voltage Vbatt, thanks to the presence of the backup energy source 20, internally within the e-latch assembly 1, and independently from any failure of the electrical connections between the same e-latch assembly 1 and the vehicle management unit 12 and/or from failures of the same vehicle management unit 12.

Figure 3:
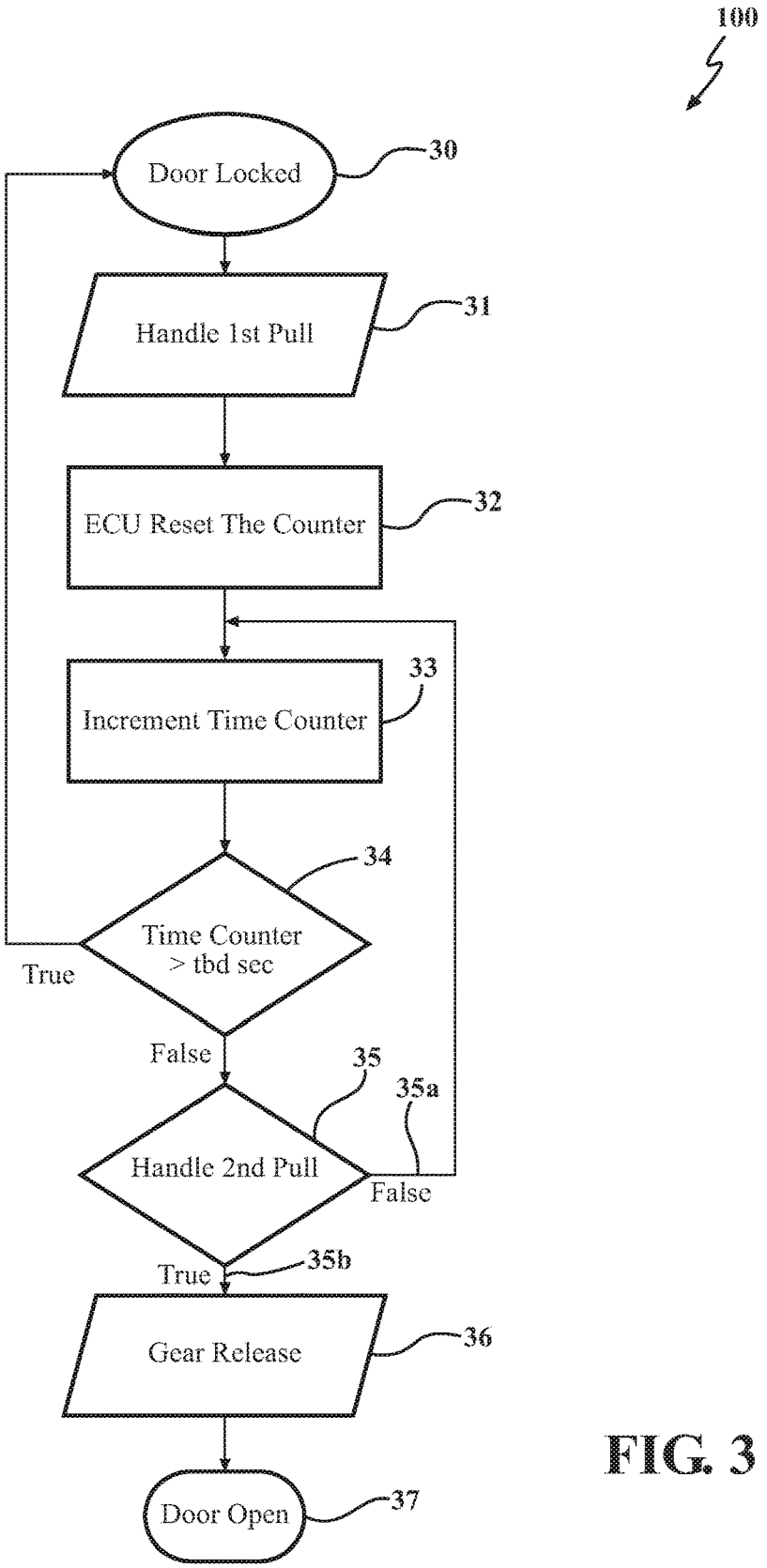
FIGS. 3 and 4 are flowcharts illustrating the steps of methods of operating the e-latch assembly according to aspects of the disclosure.

In detail, and as shown in FIG. 3, the first release management method 100 implemented by the control unit 21 of the e-latch assembly 1, includes a first step of 30 locking the e-latch assembly 1 (e.g., closure member or door 2) and monitoring for a first handle activation signal Vd. More specifically, the control unit 21 can wait for the first handle activation signal Vd, for example, by monitoring the signals Vd received from the handle sensors 16. The first handle activation signal Vd can be generated by the handle sensors 16 in any known manner, for example based on the activation of the handle 15 by the vehicle user. The method 100 then includes step of 31 receiving the first handle activation signal Vd. Advantageously, the first handle activation signal Vd can be received at an interrupt port of the control unit 21, so as to be promptly processed by the same control unit 21.

After the first handle activation signal Vd is received at step 31, the next step is determining whether a preset time X has elapsed in response to receiving the first handle activation signal Vd. More specifically, the method 100 can include 32 starting a digital counter with the control unit 21 (e.g., via the computing module 21*a*). The method 100 proceeds by, 33 incrementing the digital counter. The next steps are 34 determining whether the counter has reached a preset time X and 35 monitoring for a second handle activation signal Vd. The method 100 continues with the step of 35*a* resetting the digital counter and ignoring the first handle activation signal Vd using the control unit 21 (e.g., using the computing module 21*a*) in response to not receiving the second handle activation signal Vd within the preset time X. The method also includes the step of receiving the second handle activation signal and 35*b* determining that a multiple handle pull has occurred using the control unit (e.g., with the computing module 21*a*) in response to receiving the second handle activation signal Vd within the preset time X. In other words, the step of 33 incrementing the digital counter continues until one of two events occurs. The first event is at step 35*a*, where the counter reaches a preset time X (e.g. 1 second) before receiving of a second handle activation signal Vd, after which the computing module 21*a* resets the digital counter and receipt of the first handle activation signal Vd is zeroed (e.g., the first handle activation signal is ignored). Alternatively, the second event is at step 35*b*, where before the digital counter reaches the reset time X, a second handle activation signal Vd is received by the control unit 21, which is determined by the control unit 21 as representative of a proper multiple handle actuation event (e.g., double pull).

The method 100 continues with allowing the closure member to be opened in response to determining that a multiple handle pull has occurred. In more detail, the method 100 includes the step of 36 sending a driving signal Sd to the actuation group 6 using the control unit 21 for releasing the striker 6*b* from the ratchet 6*a* to allow the closure member (e.g., door 2) to be opened. The method 100 concludes with the step of, 37 opening of the closure member (e.g., permitting the door to be opened by the user or in a powered fashion).

As such, with the e-latch assembly 1, double pull is implemented by the control unit 21 with logic implemented by the computing module 21*a* which can provide for increased safety with a "memoryless" double pull feature where there the digital counter/timer is associated with handle 15 activation, thus dictating the second handle activation signal Vd is generated within X seconds of the first handle activation signal Vd, otherwise the e-latch assembly is reset to the locked state (e.g. receipt of the first handle activation signal Vd is ignored or zeroed). As discussed above, starting from a closure member locked situation, if the handle 15 is pulled, the release request is generated and sent (first handle activation signal Vd) to the control unit 21 for processing by the computing module 21*a* which starts the digital counter (e.g. at 0). If no second pull (second handle activation signal Vd) occurs within the defined time X, the first open request signal Vd is ignored by the computing module 21*a* and the first handle activation signal Vd is zeroed.

If the second pull occurs at or within the defined time X, the computing module 21*a* considers that a multiple (e.g. double) pull event has occurred and then sends the driving signal Sd such that the closure member is released (e.g. unlocked).

Another feature of the e-latch assembly 1 is the ability of the control unit 21 to have the double pull enabled only when the vehicle 3 is in motion (above a predetermined speed setting V stored in the memory 21*b*) by receiving a speed signal Vd from the vehicle controller (e.g. vehicle management unit 12). Once the vehicle 3 speed is below the predetermined speed setting V (e.g. 0 km/hr), only a single inside handle activation signal Vd sent to the control unit 21 is sufficient to cause the control unit 21 to send the driving signal Sd to the actuation group 6 in order to actuate the e-latch and release the door 2.

Figure 4:
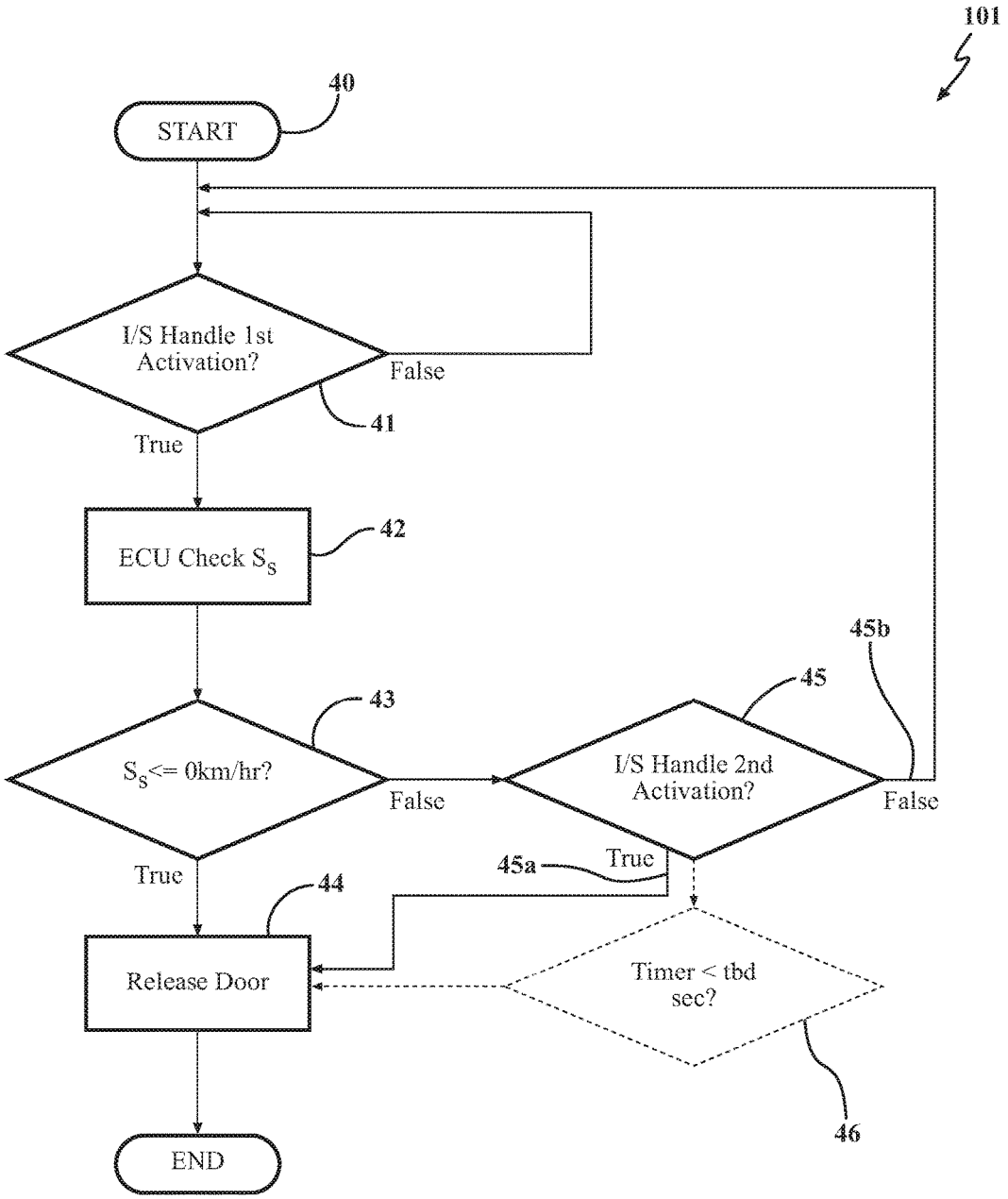

Therefore, referring to FIG. 4, the second release management method 101 includes the step of 40 locking the e-latch assembly 1 (e.g., to secure closure member or door 2). Next, 41 monitoring for a first handle activation signal Vd with the control unit 21. The method 101 continues with receiving the first handle activation signal Vd. Next, 42 checking a vehicle speed Ss (e.g., based on vehicle state information Vd received from the vehicle management unit 12). The next step of the method 101 is 43 determining whether the vehicle speed Ss satisfies a preset speed setting V (i.e., is at or below). The preset speed setting V could be stored in memory 21*b* and the computing module 21*a* of the control unit 21 can carry out a comparison, for example. The method 101 continues with releasing the closure member in response to the vehicle speed Ss satisfying the preset speed setting and receiving the first handle activation signal Vd. More specifically, the method 101 includes the step of 44 sending the driving signal Sd to the actuation group 6 with the control unit 21 in order to actuate the e-latch assembly 1 and release the door 2 in response to the vehicle speed satisfying the preset speed setting V and receiving the first handle activation signal Vd. The method 101 also includes the step of 45 monitoring for a second handle activation signal Vd (e.g., from the handle sensors 16) in response to the vehicle speed not satisfying the preset speed setting V. The method 101 continues by receiving the second handle activation signal Vd and releasing the closure member in response to receiving the second handle activation signal. Specifically, the method 101 includes the step of 45*a* sending the driving signal Sd to the actuation group 6 in order to actuate the e-latch assembly 1 and release the door 2 in response to receiving the second handle activation signal Vd. The method 101 also includes the step of 45*b* returning to the step of 41 monitoring for a first handle activation signal Vd in response to not receiving the second handle activation signal Vd.

In other words, if the vehicle speed satisfies (e.g., is at or below) the preset speed setting V (stored in memory 21*b*), as determined at step 43, then the control unit 21 sends the driving signal Sd to the actuation group 6 in order to actuate the e-latch assembly 1 and release the door 2. Otherwise at step 43, if the vehicle 3 dissatisfies (e.g., is above) the preset speed setting V, then the control unit 21 waits for a second handle activation signal Vd from the handle sensors 16 at step 45 before sending the driving signal Sd to the actuation group 6 in order to actuate the e-latch and release the door 2.

The method 101 may also include the step of 46 implementing a timer. More specifically, the control unit 21 could implement steps 32, 33, and 34 of FIG. 3 concerning timing of the second handle activation signal Vd with respect to the first handle activation signal Vd. In more detail, if the second pull Vd occurs at or within the defined time X, the computing module 21*a* considers that a multiple (e.g. double) pull event has occurred and then sends the driving signal Sd such that the door 2 is released (e.g., unlocked). Otherwise, if the second pull does not occur at or within the defined time X, the computing module 21*a* determines that a multiple (e.g. double) pull event has not occurred and thus ignores or otherwise zeros the first handle activation signal Vd and does not send the driving signal Sd in order to retain the door 2 in a locked state (e.g. the actuation group retains the striker 6*b* within the ratchet 6*a*).

As discussed above, the e-latch assembly 1 can be controlled to maintain the door 2 in a closed operating state, based on from the user actuation on the handles 15 (see FIG. 3) and/or user actuation on the handles 15 and vehicle state information Vd (e.g., vehicle speed Ss) (see FIG. 4), sensed by the handle sensors 16; to this end, the control unit 21 is configured to disable or enable the actuation group 6 from actuating the striker 6*b* of, or any other mechanical latching element coupled to, door 2 and/or the electric motor 6*d* from driving the actuation group 6. In a possible solution, the control unit 21 can read the handle sensors 16, and choose to avoid or enable any electric motor or other means of actuations (intended to release or open doors 2) based on the sensed conditions provided by the handle sensors 16 and/or the vehicle management unit 12.

Disabling/enabling operation of the (external and/or internal) handles 15 of the motor vehicle 3, or in general opening of the doors 2, can also be implemented by the control unit 21 by controlling any suitable physical disabling/enabling means coupled to the doors 2 and/or the handles 15 and/or the actuation group 6 thereof (the disabling/enabling means being configured to mechanically inhibit/facilitate opening of the same doors 2).

Clearly, changes may be made to what is described and illustrated herein without, however, departing from the scope defined in the accompanying claims. The e-latch assembly 1 may operate any kind of different closure devices within the motor vehicle 3, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure. Those skilled in the art will recognize that concepts disclosed in association with an example switching system can likewise be implemented into many other systems to control one or more operations and/or functions.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

What is claimed is:

1. A method of operating an e-latch assembly comprising an actuation group and a control unit, the e-latch assembly coupled to a closure member and comprising the steps of:

monitoring for a plurality of handle activation signals;

receiving one of the plurality of handle activation signals;

checking a vehicle speed;

determining whether the vehicle speed satisfies a preset speed setting;

releasing the closure member in response to the vehicle speed satisfying the preset speed setting and receiving the one of the plurality of handle activation signals;

monitoring for additional ones of the plurality of handle activation signals in response to the vehicle speed not satisfying the preset speed setting;

receiving at least one of the additional ones of the plurality of handle activation signals; and releasing the closure member in response to receiving the at least one of the additional ones of the plurality of handle activation signals.

2. The method as set forth in claim 1, further including the step of returning to the step of monitoring for the plurality of handle activation signals in response to not receiving the additional ones of the plurality of handle activation signals.

3. The method as set forth in claim 1, wherein the step of checking a vehicle speed includes receiving vehicle state information from a vehicle management unit.

4. The method as set forth in claim 1, further including the step of determining whether a preset time has elapsed and wherein the step of monitoring for additional ones of the plurality of handle activation signals in response to the vehicle speed not satisfying the preset speed setting includes monitoring for the additional ones of the plurality of handle activation signals in response to the preset time not being elapsed and in response to the vehicle speed not satisfying the preset speed setting.

5. The method as set forth in claim 4, wherein the step of determining whether the preset time has elapsed includes starting a digital counter and incrementing the digital counter and wherein the step of determining whether the preset time has elapsed includes determining whether the digital counter has reached the preset time.

6. The method as set forth in claim 5, further including the step of resetting the digital counter in response to not receiving the additional ones of the plurality of handle activation signals within the preset time.

7. The method as set forth in claim 4, further including the steps of:

ignoring the one of the plurality of handle activation signals in response to not receiving the at least one of the additional ones of the plurality of handle activation signals within the preset time; and determining that the multiple handle pull has occurred in response to receiving the at least one of the additional ones of the plurality of handle activation signals within the preset time.

8. The method as set forth in claim 1, further including the step of storing the preset speed setting in a memory of the control unit and wherein the step of determining whether the vehicle speed satisfies a preset speed setting includes carrying out a comparison of the vehicle speed to the preset speed setting using a computing module of the control unit.

9. The method as set forth in claim 1, wherein the preset speed is 0 km/hr.

10. An e-latch assembly for a closure member comprising:

an actuation group operable to selectively secure the closure member;

an electronic control circuit coupled to said actuation group and including a control unit configured to:

manage a plurality of handle activation signals, receive a plurality of signals indicative of the state of a vehicle including at least one of a vehicle speed and an accelerometer reading and a force sensor reading, control said actuation group to selectively allow the closure member to be opened in response to receiving the plurality of signals indicative of the state of the vehicle and based on the plurality of handle activation signals, disregard the plurality of signals based on the state of the vehicle, monitor for a first handle activation signal, receive the first handle activation signal, check a vehicle speed, determine whether the vehicle speed satisfies a preset speed setting, release the closure member in response to the vehicle speed satisfying the preset speed setting and receiving the first handle activation signal, monitor for a second handle activation signal in response to the vehicle speed not satisfying the preset speed setting, receive the second handle activation signal, and release the closure member in response to receiving the second handle activation signal.

11. The e-latch assembly as set forth in claim 10, wherein said control unit is further configured to:

determine whether a preset time has elapsed, monitor for the second handle activation signal in response to the preset time not being elapsed, ignore the first handle activation signal in response to not receiving the second handle activation signal within the preset time, receive the second handle activation signal, determine that a multiple handle pull has occurred in response to receiving the second handle activation signal within the preset time, and allow the closure member to be opened in response to determining that a multiple handle pull has occurred.

12. The e-latch assembly as set forth in claim 10, wherein said control unit is further configured to receive signals indicative of a correct authentication of a user.

13. An e-latch assembly for a closure member comprising:

an actuation group operable to selectively secure the closure member;

an electronic control circuit coupled to said actuation group and including a control unit configured to:

monitor for a plurality of handle activation signals, receive one of the plurality of handle activation signals, determine whether a first preset time has elapsed in response to receiving the one of the plurality of handle activation signals, monitor for additional ones of the plurality of handle activation signals in response to the first preset time not being elapsed, ignore the one of the plurality of handle activation signals and not send a driving signal to the actuation group after receiving the one of the plurality of handle activation signals in response to not receiving the additional ones of the plurality of handle activation signals within the first preset time, receive at least one of the additional ones of the plurality of handle activation signals, determine that a multiple handle pull has occurred in response to receiving the at least one of the additional ones of the plurality of handle activation signals within the first preset time, allow the closure member to be opened by sending the driving signal to the actuation group in response to determining that the multiple handle pull has occurred, check a vehicle speed, determine whether the vehicle speed satisfies a preset speed setting, enable the sending of the driving signal to said actuation group to release the closure member in response to the vehicle speed satisfying the preset speed setting and receiving the one of the plurality of handle activation signals, monitor for additional ones of the plurality of handle activation signals in response to the vehicle speed not satisfying the preset speed setting, receive at least one of the additional ones of the plurality of handle activation signals, and enable the sending of the driving signal to said actuation group to release the closure member in response to receiving the at least one of the additional ones of the plurality of handle activation signals.

14. The e-latch assembly as set forth in claim 13, wherein said control unit is further configured to:

start a digital counter, increment the digital counter, and determine whether the digital counter has reached the first preset time.

15. The e-latch assembly as set forth in claim 14, wherein said control unit is further configured to reset the digital counter in response to not receiving the at least one of the additional ones of the plurality of handle activation signals within the first preset time.

16. The e-latch assembly as set forth in claim 14, wherein said actuation group is configured to release a striker from a ratchet to allow the closure member to be opened in response to receiving the driving signal.

* * * * *